US005902073A

United States Patent [19]

Eungard et al.

[11] Patent Number: 5,902,073

[45] **Date of Patent: *May 11, 1999**

[54] EQUIPMENT SUPPORT GARMENT FOR DIVERS

[75] Inventors: William C. Eungard, Waterford; Thomas R. Swetish, Racine, both of Wis.

[73] Assignee: Johnson Worldwide Associates, Sturtevant, Wis.

[ * ] Notice: This patent is subject to a terminal disclaimer.

[21] Appl. No.: 08/780,505

[22] Filed: Jan. 8, 1997

[51] Int. Cl.[6] ..... B63C 11/10; A45F 3/08

[52] U.S. Cl. ..... 405/187; 2/2.15; 224/638; 224/934; 405/186

[58] Field of Search ..... 405/185, 186, 405/187; 114/315; 2/462, 2.15, 2.17, 312; 441/88, 92, 102, 111, 114; 224/638, 934, 160, 628, 637–640, 210, 211

[56] References Cited

U.S. PATENT DOCUMENTS

| | | | |
|---|---|---|---|
| D. 299,286 | 1/1989 | Faulconer et al. | D3/216 |
| D. 300,340 | 3/1989 | Faulconer | D21/238 |
| 2,982,105 | 5/1961 | Akers | 405/186 |
| 3,135,098 | 6/1964 | Root | 405/186 |
| 3,263,432 | 8/1966 | Maskell | 405/186 |
| 3,536,071 | 10/1970 | Ferrando | 128/202.14 |
| 3,670,509 | 6/1972 | Walters | 405/186 |
| 3,842,611 | 10/1974 | Anderson | 405/186 |
| 3,877,098 | 4/1975 | Braly | 405/186 |
| 3,885,722 | 5/1975 | Robertson | 224/261 |
| 3,957,183 | 5/1976 | Gadberry | 224/628 |
| 3,964,266 | 6/1976 | Bartlett | 405/186 |
| 4,000,534 | 1/1977 | Cerniway et al. | 405/186 |
| 4,016,616 | 4/1977 | Walters | 405/186 |
| 4,310,110 | 1/1982 | Dexter | 224/246 |
| 4,324,234 | 4/1982 | Maness | 128/202.14 |
| 4,440,525 | 4/1984 | Perla | 405/186 |
| 4,449,655 | 5/1984 | Germe | 224/153 |
| 4,523,914 | 6/1985 | Faulconer et al. | 441/108 |
| 4,561,853 | 12/1985 | Faulconer et al. | 441/106 |
| 4,579,264 | 4/1986 | Napolitano | 224/160 |
| 4,608,940 | 9/1986 | Bulin | 405/186 |
| 4,623,316 | 11/1986 | Ratliff | 441/106 |
| 4,690,314 | 9/1987 | Faulconer et al. | 224/628 |
| 4,694,772 | 9/1987 | Faulconer et al. | 114/315 |
| 4,739,913 | 4/1988 | Moore | 224/643 |
| 4,752,263 | 6/1988 | Pritchard et al. | 114/88 |
| 4,778,307 | 10/1988 | Faulconer | 405/186 |
| 4,779,554 | 10/1988 | Courtney | 114/315 |
| 4,810,134 | 3/1989 | Faulconer et al. | 405/186 |
| 4,877,167 | 10/1989 | McNemar | 224/269 |
| 4,887,932 | 12/1989 | Toth | 405/186 |
| 4,913,589 | 4/1990 | Faulconer et al. | 405/186 |

(List continued on next page.)

FOREIGN PATENT DOCUMENTS

| | | |
|---|---|---|
| 2 259 010 | 1/1974 | France . |
| 2590540 | 5/1987 | France . |
| 964217 | 7/1964 | United Kingdom . |

OTHER PUBLICATIONS

1995 Catalog entitled "Zeagle Dive Without a Weight Belt" 16 pages; Zeagle Systems, Inc.; Zephyrhills, Florida.

Skin Diver, "Our Business Is Underwater", Oct. 1962.

*Primary Examiner*—Tamara Graysay
*Assistant Examiner*—Tara L. Mayo
*Attorney, Agent, or Firm*—Foley & Lardner

[57] ABSTRACT

A support garment for diving equipment includes several subassemblies for providing comfortable support of diving equipment, such as a tank of pressurized breathing gas, a buoyancy compensating air cell and a ballast weight pocket assembly. A frame is adjustably secured to a shoulder support assembly that includes adjustment straps for accommodating various body sizes. A belt assembly is pivotally secured to the lower portion of the frame. A bust or chest panel extends between shoulder supports, providing a secure and comfortable fitting structure for divers of various body types, particularly women. Elements of the garment are secured to one another via rivets placed at predetermined locations, thereby facilitating assembly and servicing of the garment.

39 Claims, 6 Drawing Sheets

U.S. PATENT DOCUMENTS

| | | | |
|---|---|---|---|
| 4,918,790 | 4/1990 | Cirket et al. | 24/71 R |
| 4,952,095 | 8/1990 | Walters | 405/186 |
| 4,990,115 | 2/1991 | Vorhauer et al. | 441/111 |
| 5,011,334 | 4/1991 | Vorhauer | 405/186 |
| 5,020,941 | 6/1991 | Bulin et al. | 405/186 |
| 5,046,894 | 9/1991 | Bergstrom | 405/186 |
| 5,074,714 | 12/1991 | Franco | 405/186 |
| 5,085,163 | 2/1992 | VanTassel et al. | 405/186 |
| 5,119,767 | 6/1992 | Jimenez | 119/96 |
| 5,205,672 | 4/1993 | Stinton | 405/186 |
| 5,249,890 | 10/1993 | Bergstrom | 405/186 |
| 5,256,094 | 10/1993 | Canna | 441/96 |
| 5,295,765 | 3/1994 | Choi | 405/186 |
| 5,311,833 | 5/1994 | VanTassel et al. | 114/315 |
| 5,346,419 | 9/1994 | Kaiser | 441/96 |
| 5,363,790 | 11/1994 | Matsuoka | 114/315 |
| 5,441,186 | 8/1995 | Halligan | 224/159 |
| 5,441,367 | 8/1995 | Toth | 405/186 |
| 5,497,922 | 3/1996 | Tate | 224/160 X |
| 5,509,590 | 4/1996 | Medeiros, Jr. et al. | 224/161 |
| 5,516,234 | 5/1996 | Duchesne | 405/186 |
| 5,641,247 | 6/1997 | Seligman | 405/186 |
| 5,662,433 | 9/1997 | Seligman | 405/186 |

11
32
28
10
22
14
102
128
30
20
12
124
88
16
18
96
94
80
82
90
92
94
80

FIG. 4A
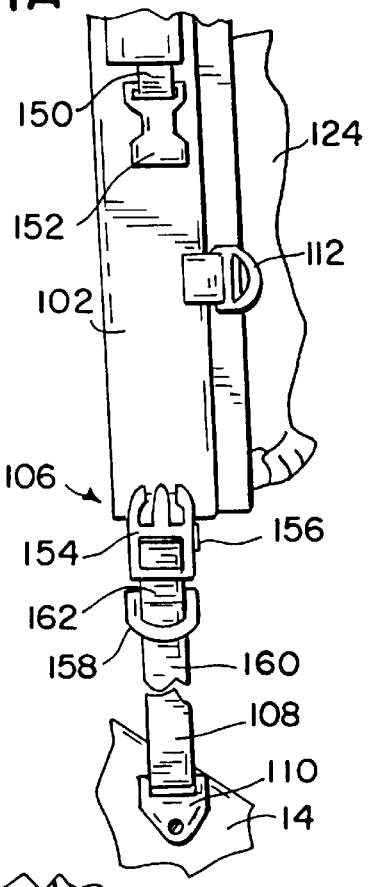
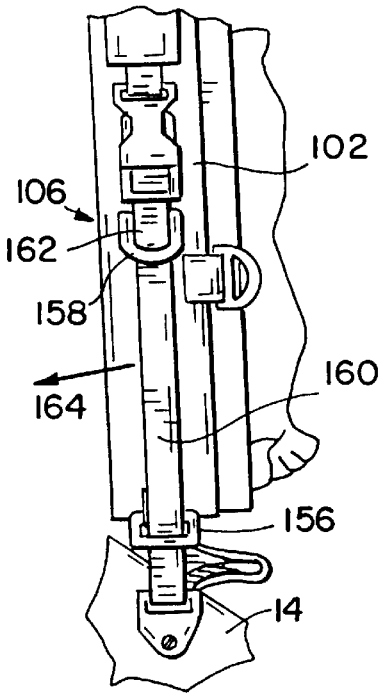
FIG. 4C
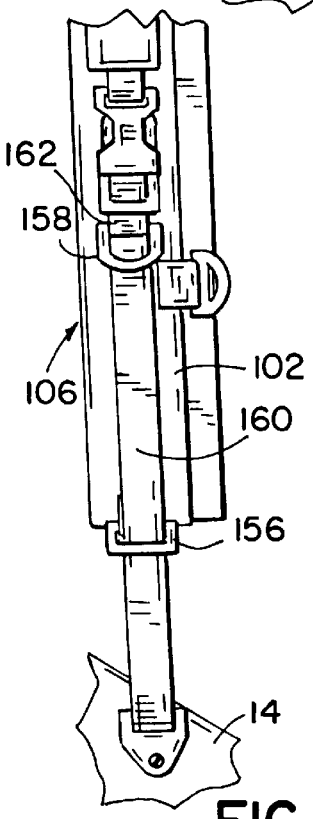
FIG. 4B
FIG. 4D
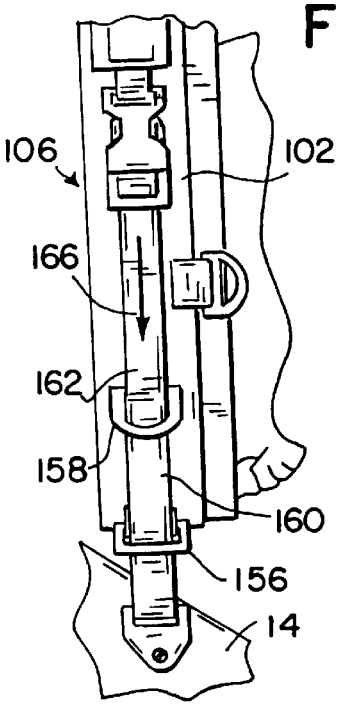

FIG. 5
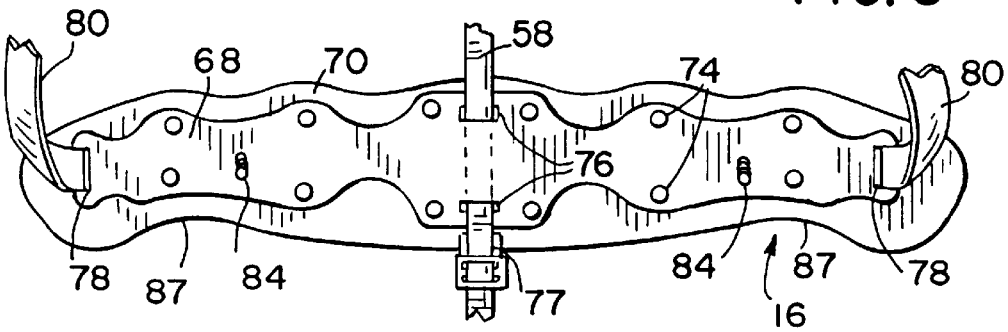
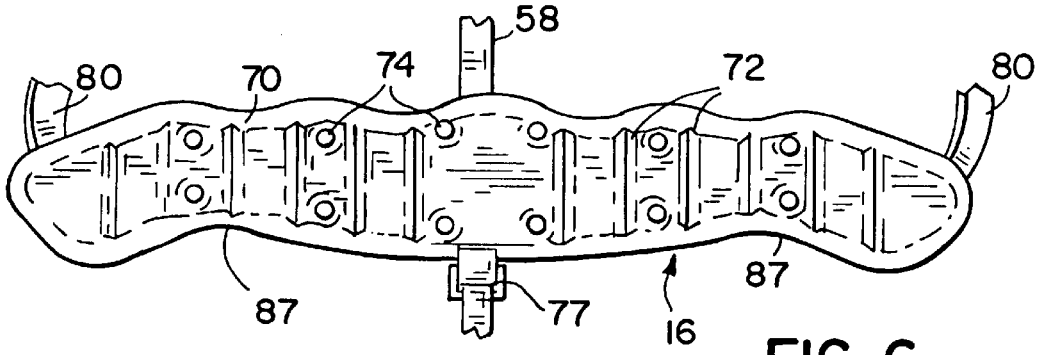
FIG. 6
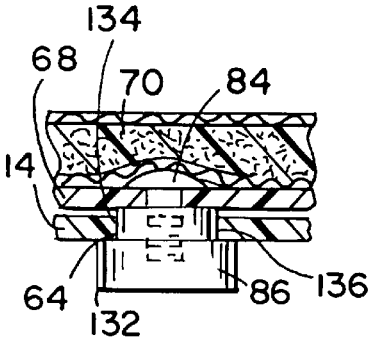
FIG. 8
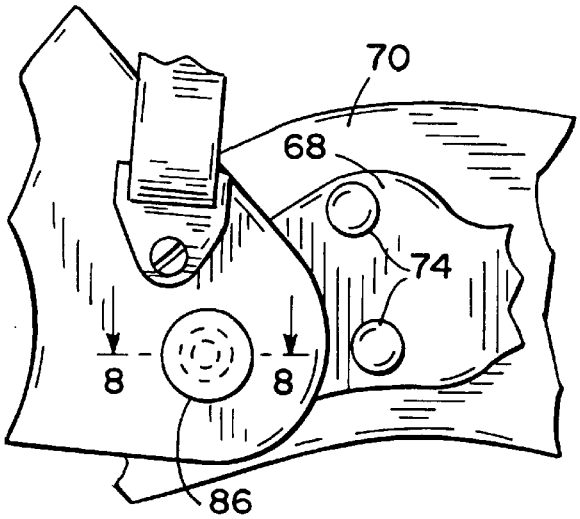
FIG. 7

EQUIPMENT SUPPORT GARMENT FOR DIVERS

BACKGROUND OF THE INVENTION

The present invention relates generally to devices used by underwater divers for supporting equipment and for maintaining neutral buoyancy during dives. More particularly, the invention relates to an improved buoyancy compensator, particularly well suited for use by women, that more comfortably conforms to the divers body morphology and more effectively supports loads encountered both underwater during a dive and out of the water during preparation for and following a dive.

Various structures have been proposed and are currently available for supporting equipment used by underwater divers. Such structures often include a support harness and backpack for holding one or more pressurized diving tanks behind the divers back. A buoyancy compensating device, often referred to as a "BC," may be incorporated with the tank support structure, or may be provided as a separable unit. Such BC's typically include a sealed bladder or air cell that can be selectively inflated or vented by the diver as needed to maintain a neutral buoyancy during the dive, thus facilitating underwater activities and swimming. A weight system may be incorporated into the BC to allow the diver to insert and remove weights for additional buoyancy control.

Known BC structures are configured to fit snugly around the diver's torso, such as by adjustable straps wrapping around the diver's shoulders and waist. Where a tank supporting backpack is incorporated in the device, the position of the backpack may sometimes be made adjustable by means of the strap arrangement. Moreover, certain BC's may incorporate an integrated ballast weight system into a unitary structure. Where a weight system is not included in the BC, the diver will often opt to wear a separate weight belt below the tank support and BC structure.

While such BC devices have substantially improved the comfort and facility of underwater diving, they are not without drawbacks. For example, despite the adjustability of known BC and tank support systems, they are often uncomfortable or unwieldy for certain divers, such as women. Generally, with few exceptions, heretofore known tank supports and BC's have been designed similar to orienteering backpacks, having a pair of shoulder straps, a sternum strap and a waist belt, all designed for use by men of relatively standard size and morphology. As a result, such structures often provide insufficient adjustability for smaller persons. Moreover, the shoulder strap, backpack and sternum strap arrangements of conventional tank supports and BC's are not well suited to the upper body configuration of most women. While attempts have been made to improve or adapt such structures for women and other divers, these have provided only limited success.

There is a need, therefore, for a tank support and buoyancy compensating device that provides a greater degree of comfort and adjustability for a range of body morphologies, especially those of women. In particular, there is a need for an improved diving garment that will fit comfortably, yet securely over the bust and hip regions, without unduly limiting the diver's freedom of movement or compromising the effectiveness of the support. The device should advantageously provide for adequate and comfortable support of diving equipment, such as a pressurized air tank, a BC air cell and a weight system, both during underwater dives and out of water during transport, preparation and following dives.

SUMMARY OF THE INVENTION

The invention features a diving equipment support designed to respond to these needs. The support incorporates a novel bust panel secured snugly between shoulder supports when the garment is worn, thereby providing a comfortable and effective upper body structure on which equipment may be supported. The device is preferably configured as a vest or harness secured to a generally triangular frame. The frame provides a support for an air tank and an air cell. A waist belt is pivotally attached to the frame and may be comfortably secured around the diver's hips for transmitting loads to the diver's hips both during dives and during transport or preparation for dives. A ballast weight system is preferably integrated into the device. The resulting structure provides a comfortable and complete equipment support that may be adapted for use by divers of diverse morphologies, particularly women.

In accordance with a first aspect of the invention, an equipment support garment is provided for use by an underwater diver. The garment includes first and second shoulder panels, an air cell and a bust panel. The shoulder panels are configured to extend over the shoulders of the diver, and left and right portions of the diver's chest. The air cell is coupled to the first and second panels, and comprises an air tight inner compartment for receiving compressed air. The bust panel extends between the first and second panels and is configured to substantially cover the diver's chest.

In accordance with another aspect of the invention, an equipment support garment for use by an underwater diver includes a generally triangular frame, a pair of shoulder supports, and a belt assembly. The frame includes a panel for supporting an element of diving equipment, such as a tank of pressurized gas, an air cell or a ballast weight pocket assembly. Lower support extensions on the frame are configured to at least partially encompass the diver's hips. The shoulder supports are coupled to the frame for supporting the frame on the diver's back. The belt assembly is pivotally coupled to the lower support extensions and configured to extend around the diver's hips.

In accordance with a further aspect of the invention, a buoyancy compensator is provided for use by underwater divers, and includes a backpack, a pair of shoulder supports, an air cell, a belt assembly and an elastic bust panel. The backpack, which is preferably formed of a triangular frame, is configured to receive and support a tank of pressurized gas. The shoulder supports are coupled to the backpack and are configured to extend over the diver's shoulders when worn. The air cell is coupled to the backpack and includes an air tight inner compartment for receiving pressurized gas. The belt assembly is coupled to the backpack and is configured to extend around the diver's hips when worn. The bust panel extends between the shoulder supports and is configured to cover at least a portion of the diver's chest when worn.

In accordance with a further aspect of the invention, an equipment support garment for use by an underwater diver, includes an element of diving equipment, a frame and a pair of shoulder supports. The element of diving equipment has a plurality of first apertures formed therein at predetermined locations. The frame includes a panel for supporting the element of diving equipment, and has a plurality of second apertures formed therein at locations corresponding to the predetermined locations of the first apertures. A plurality of fasteners are disposed in mutually aligned first and second apertures and extend between the element of diving equipment and the frame thereby securing the element of diving equipment to the frame. In a particularly preferred arrangement, the fasteners are rivets that may be selectively removed from the garment for replacement of the element of diving equipment.

A similar structure is contemplated for a belt assembly for a diving equipment support garment. The belt assembly includes a pad attached to a support panel via a plurality of fasteners, such as rivets, disposed at predetermined locations on the panel.

BRIEF DESCRIPTION OF THE DRAWINGS

The present invention will become more fully understood from the following detailed description, taken in conjunction with the accompanying drawings, wherein like reference numerals refer to like parts, in which:

FIGS. 4A–4D are front elevational views of a preferred arrangement of webbing straps on the shoulder supports of the garment, illustrating the manner in which the webbing may be joined and tightened when worn, and easily extended to a release position for removal of the garment;

FIGS. 5 and 6 are rear and front views of the belt assembly, respectively, of the garment of FIG. 1;

FIG. 7 is a detail view of a lower support extension of the frame shown in FIG. 3A, illustrating a preferred arrangement for attaching the frame to the belt assembly; and FIG. 8 is a sectional view along line 8—8 of FIG. 7, illustrating a preferred structure for pivotally attaching the frame to the belt assembly.

DESCRIPTION OF THE PREFERRED EMBODIMENTS

Figure 1:
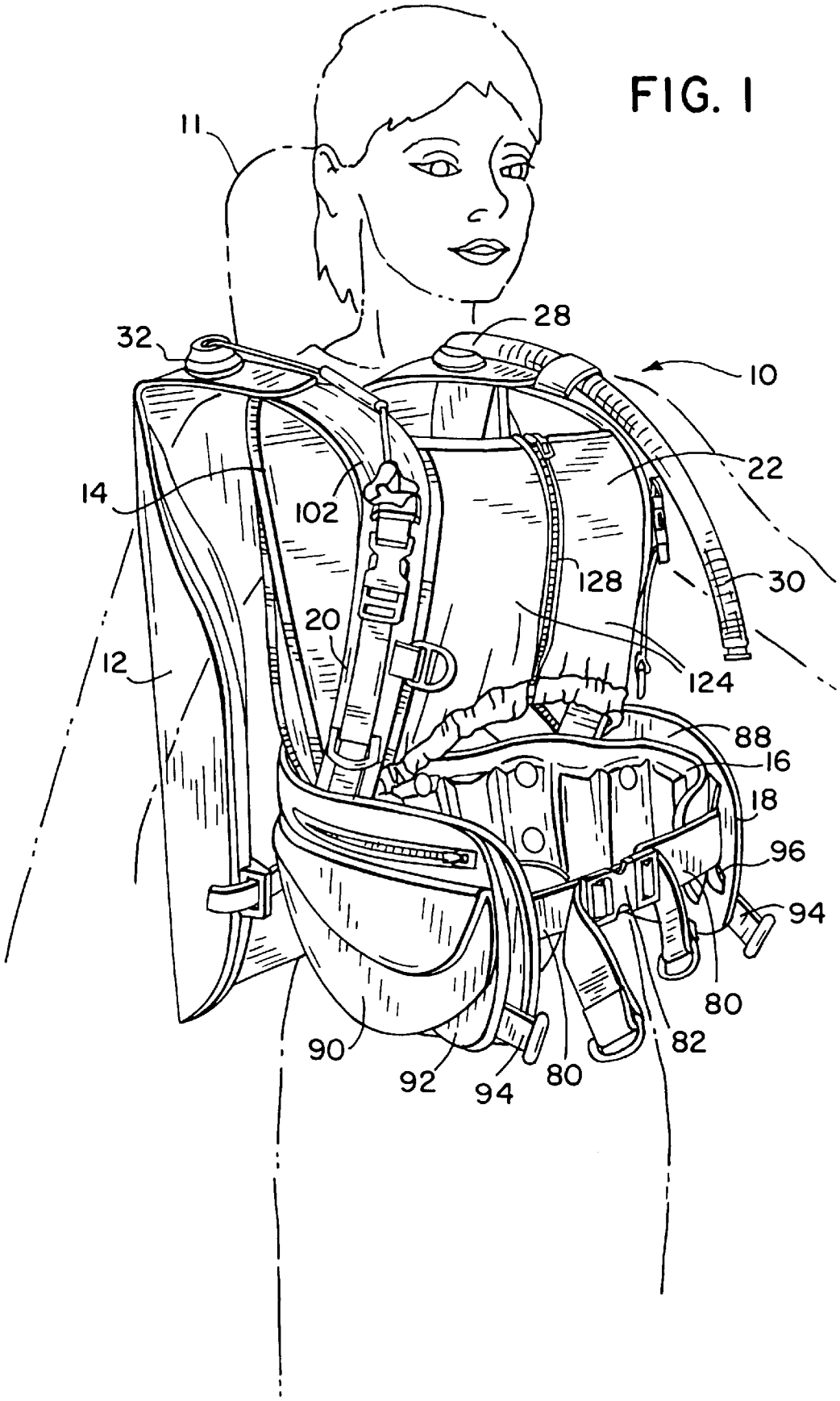
FIG. 1 is a perspective view of a diver's equipment support garment in accordance with the invention, shown secured around the shoulders and waist of a diver.

Turning now to the drawings and referring to FIG. 1, a diving equipment support garment, referred to generally by the reference numeral 10, is illustrated as including an air cell assembly 12, a frame 14, a belt assembly 16, a ballast weight or pocket assembly 18, a shoulder strap assembly 20 and a bust panel assembly 22. These various subassemblies are preferably preassembled and brought together in the completed garment as described in greater detail below. While, in general, garment 10 may include some or all of the subassemblies mentioned above, the collection of subassemblies forms an integrated, complete diving equipment support capable of accommodating a diving tank, ballast weights and a buoyancy compensating air cell in a comfortable and manageable unit.

Figure 2:
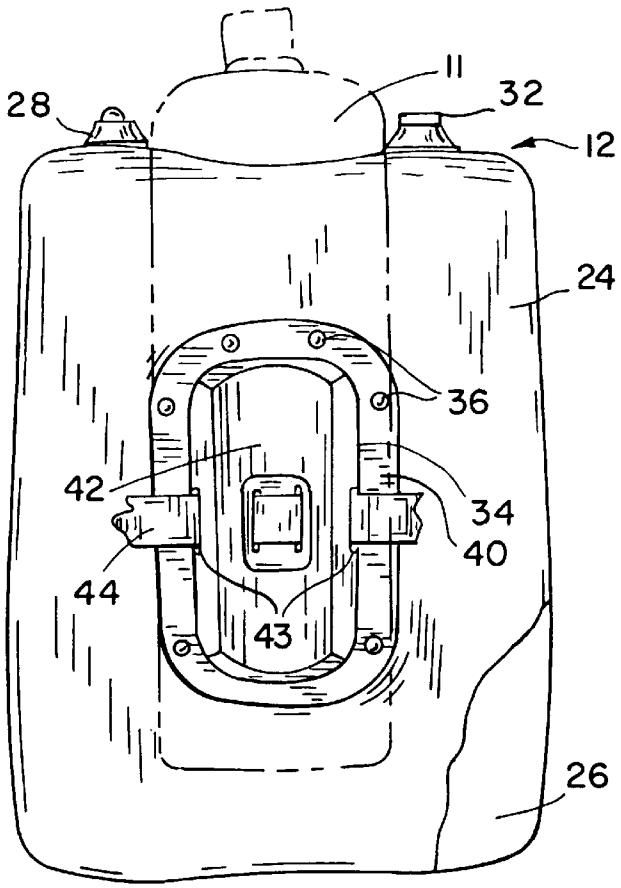
FIG. 2 is a rear view of the garment of FIG. 1, illustrating a preferred arrangement of the air cell and tank support on the backpack.

As best shown in FIG. 2, air cell assembly 12 includes a multi-ply air cell 24 enclosing an air tight air chamber 26 capable of receiving compressed gas. Air cell 24 may be of generally known construction, such as including two or more plies of air-impervious fabric ultrasonically welded or otherwise sealed to one another. A fill valve 28 is provided for selectively introducing compressed gas into air chamber 26, such as via a flexible tube 30 (see FIG. 1), for increasing the buoyant forces on the diver as needed. A venting valve 32 is also provided in assembly 12 for selectively permitting gas to escape from air cell 24. An aperture 34 is formed in air cell 24 through which a portion of frame 14 protrudes for support of a tank of pressurized gas 11. Air cell assembly 12 is preferably attached to frame 14 via rivets 36 extending through preformed holes 38 (see FIG. 3B) in a peripheral flange 40 surrounding aperture 34, as described in greater detail below. Finally, a pair of elastic webbing straps 41 are provided on either side of air cell 24, to facilitate restraint of the air cell laterally in the final assembled garment.

Figure 3C:
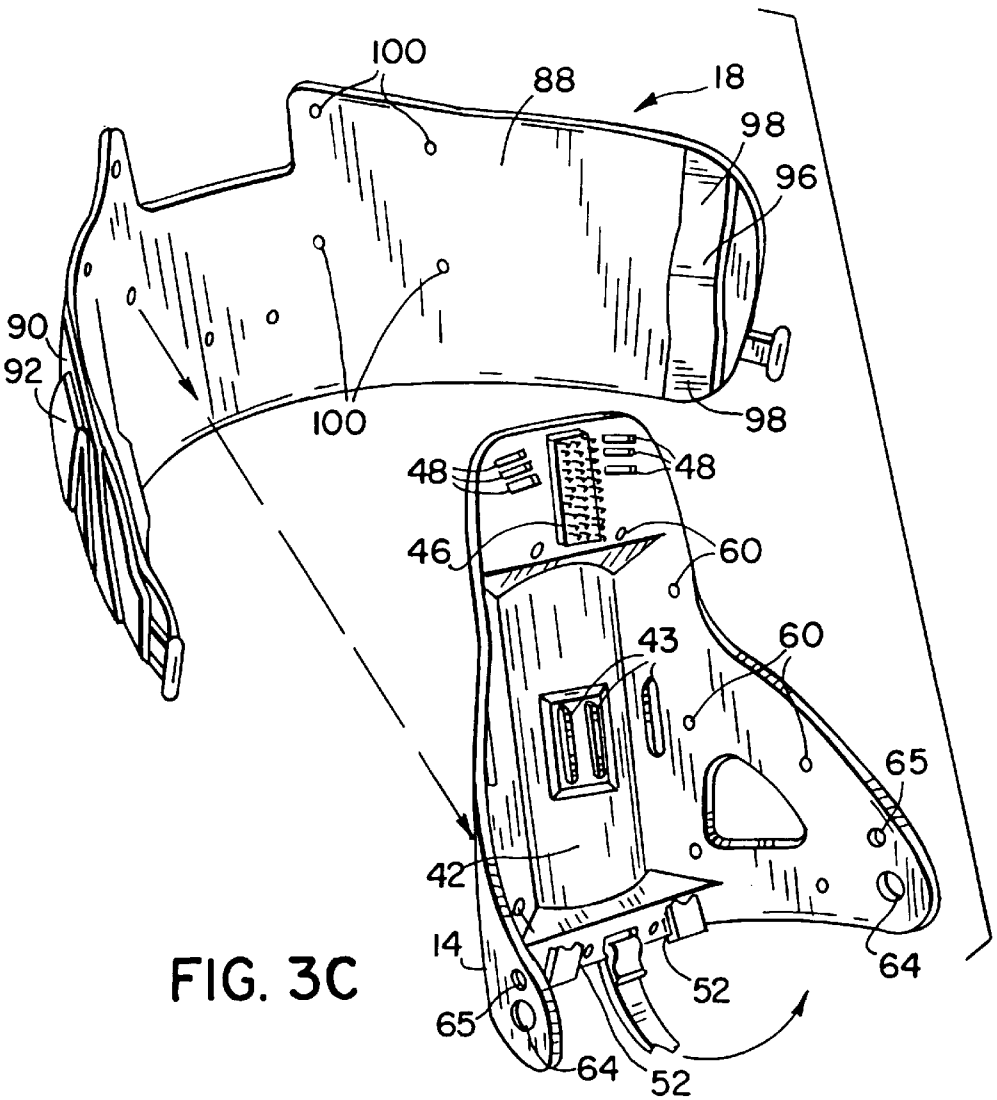
FIG. 3C is an exploded view of the frame and pocket assembly of the garment of FIG. 1.
Figure 3A:
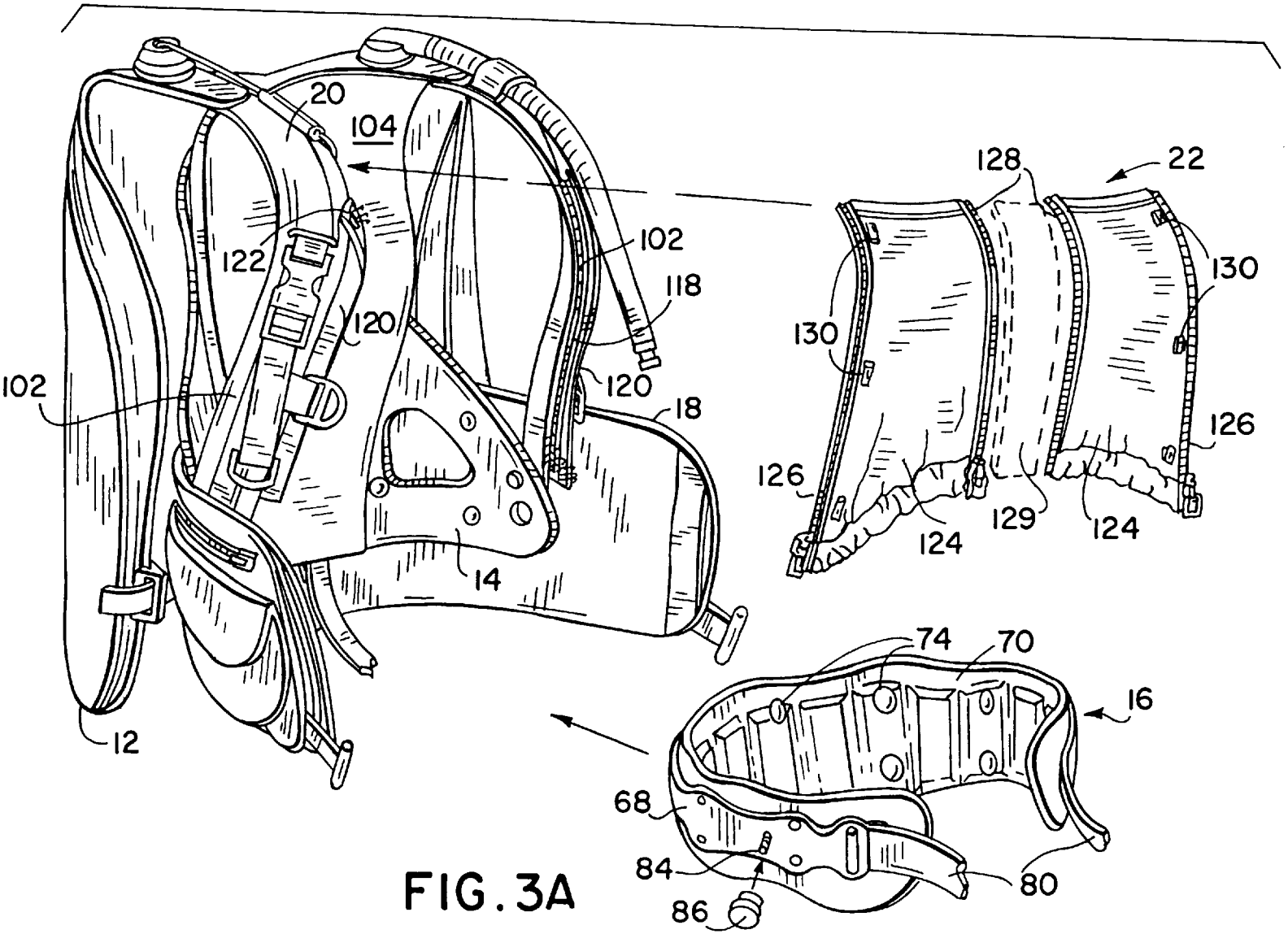
FIG. 3A is a partially exploded view of the garment of FIG. 1, wherein the bust panels and belt assembly have been removed for explanatory purposes.
Figure 3B:
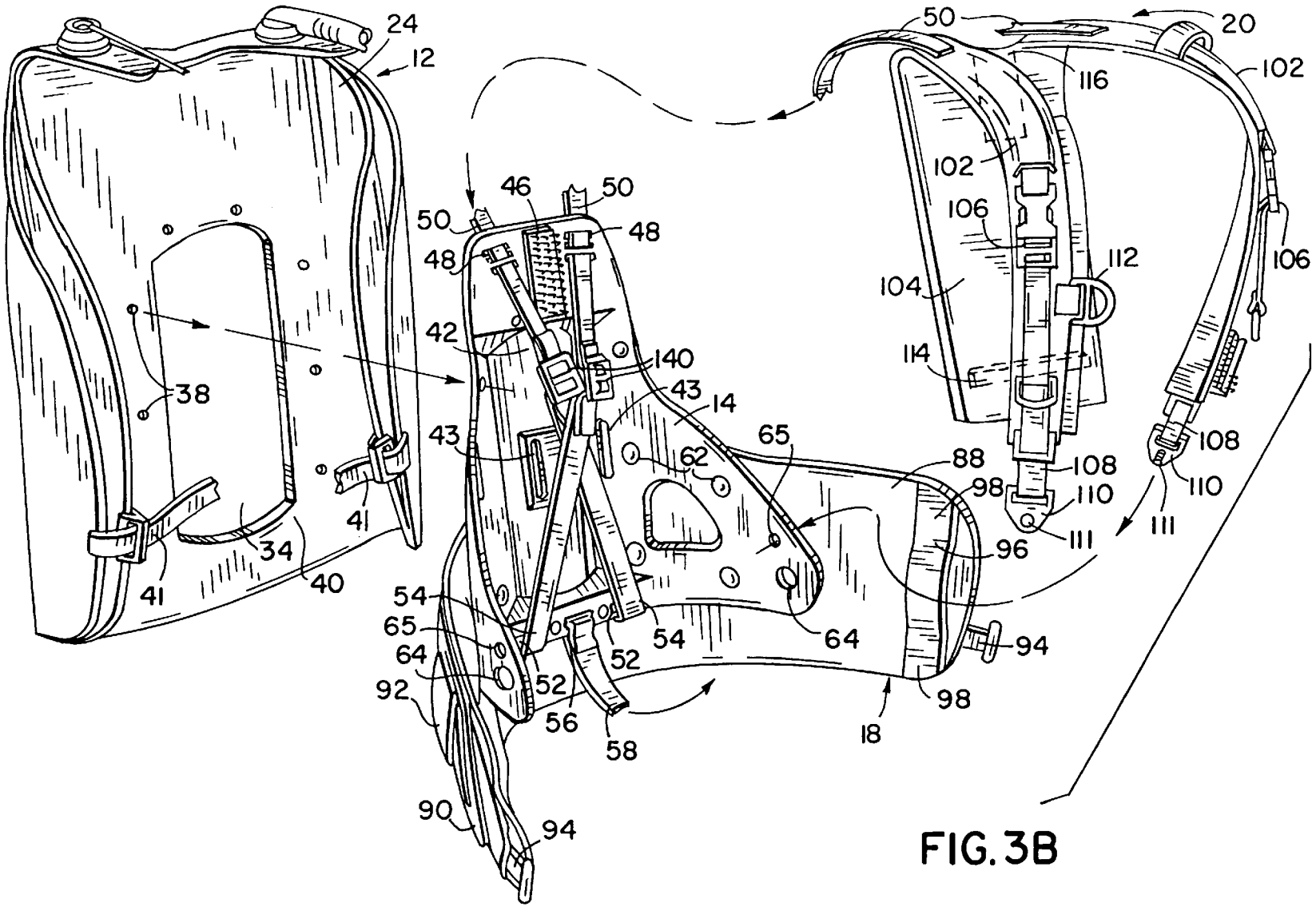
FIG. 3B is a partially exploded view of the garment of FIG. 1, wherein the air cell and shoulder support assemblies have been removed for explanatory purposes.

Referring to FIGS. 3B and 3C, frame 14 is preferably formed from a substantially rigid plastic material preformed in a generally triangular shape. It should be noted, however, that frame 14 may be formed of any suitable rigid material, such as metal plate, and may assume various alternative shapes, depending upon the desired size, fit and functions of the resulting frame. Features facilitating attachment of frame 14 to the other subassemblies of garment 10 are preferable preformed in frame 14. Thus, in the preferred embodiment illustrated, frame 14 includes an elongated tank support cavity or recess 42 adjacent to which a series of slots 43 are formed for a tank retaining belt 44 of generally known design. Above tank support recess 42, frame 14 preferably includes one portion of a hook and loop fastener arrangement along a region 46 for securing a back pad of shoulder strap assembly 20 as described below. A series of upper slots 48 are formed in frame 14 to permit passage of webbing straps 50 from shoulder strap assembly 20 (see FIG. 3B). Lower slots 52 are provided adjacent to a lower edge of frame 14 for lower attachment straps 54 designed to receive and cooperate with straps 50 for adjustment of garment 10 as described below. A central slot 56 is provided in the same region for attachment of a lumbar or pivot control strap 58 of belt assembly 16.

A series of holes or apertures 60 are provided at predetermined locations for receiving attachment rivets 62 or similar fasteners used to secure the various elements of garment to frame 14 in a rapid and economical manner. While heretofore known diving equipment supports have typically secured backpack plates to other elements by straps or stitching, the present structure preferably makes use of two-part rivets, commercially available in various sizes to accommodate different thicknesses of interposed materials, to secure both air cell assembly 12 and pocket assembly 18 to frame 14 (as well as to assembly elements of belt assembly 16 to one another). The use of such rivets, which are preferably made of a plastic material, avoids the need to stitch through frame 14, and may allow removal and replacement of air cell assembly 12 in the event of damage to the air cell.

A pair of lateral apertures 64 are provided in lower comers of frame 14 for receiving bolts for pivotally attaching belt assembly 16 to frame 14 as described below. Finally, a pair of holes 65 are formed adjacent to apertures 64 for later attachment of lower ends of shoulder strap assembly 20. In the presently preferred embodiment, frame 14 is formed of a hard, rigid thermoformable plastic material, then trimmed and pierced via a subsequent machining operation to form the slots and apertures described above.

As best shown in FIGS. 3A, 5 and 6, belt assembly 16 includes a substantially rigid, unitary panel 68 fixed to an elongated pad 70. Panel 68 is preferably formed from a resilient plastic material. Pad 70 is a multiply, thermowelded assembly including a fabric shell covering a compressible foam core. During forming, tacked regions 72 are formed in pad 70 and apertures (not shown) are pierced therethrough for receiving rivets 74. Similarly placed apertures (not shown) are formed in panel 68, and rivets 74, which may be substantially identical to rivets 62, are assembled to securely attach pad 70 to panel 68. Panel 68 also includes a pair of slots 76 for pivot control strap 58. A short attachment strap 77, including a ladder lock or similar attachment device is secured to pad 70 near lower slot 76 for attachment to pivot control strap 58, as described below. A pair of slots 78 are provided adjacent to ends of panel 68 for receiving a pair of buckle straps 80. Buckle straps 80 terminate in a pair of matable quick release buckle elements 82 (see FIG. 1) for securing belt assembly 16 around the diver's waist. A pair of threaded bolts 84 are secured to panel 68 at lateral pivot locations, and a pair of hand-adjustable nuts 86 are provided for securing bolts 84 in apertures 64 of frame 14, as described below with reference to FIGS. 7 and 8.

It should be noted that belt assembly 16 is preferably contoured along its lower edge to provide recesses 87, as shown in FIGS. 5 and 6. These recesses are placed to correspond to the approximate location of the diver's hips such that belt assembly 16, when secured tightly around the diver's hips, will comfortably conform to the diver's pelvic structure. It has been found that this preferred contour provides superior support of the equipment attached to garment 10 while remaining comfortable during extended dives.

Referring to FIGS. 1, 3B and 3C, pocket assembly 18 is preferably formed from several plies of synthetic fabric joined by stitching. Thus, pocket assembly 18 includes a base panel 88 on which pocket panels 90 are secured. Pocket panels 90 typically provide compartments for storage of articles such as tools and the like. Some or all of pocket panels 90 may form weight storage compartments 92 for releasably receiving ballast weights (not shown) in a manner generally known in the art of buoyancy compensating devices. Where such weight compartments 92 are provided, rapid or emergency release handles 94 will typically be included to permit quick release of ballast weights. On an inner face of pocket assembly 18, a pair of restraining panels or strips of webbing 96 are secured at upper and lower attachment points 98, such as by stitching. Restraining panels or webbing 96 permit pocket assembly 18 to be held inward somewhat by cooperation with buckle straps 80 of belt assembly 16, as described below. As best illustrated in FIG. 3C, a series of attachment holes 100 are preferably formed in pocket assembly 18 for receiving attachment rivets 62 for securing pocket assembly 18 to air cell assembly 12 and to frame 14.

Referring now to FIGS. 1, 3A and 3B, shoulder strap assembly 20 includes a pair of padded shoulder straps or supports 102 extending from a back pad 104. In the presently preferred embodiment, shoulder straps 102 and back pad 104 are formed as separate assemblages of synthetic fabric strips encasing foam pads. Shoulder straps 102 are then stitched to back pad 104 to form a unitary subassembly. Upper attachment straps 50 are stitched to an upper region of shoulder straps 102, while a adjustment strap assembly 106 is stitched to a front region thereof Adjustment strap assemblies 106, described below with reference to FIGS. 4A–4D, facilitate fitting of garment 10 when worn as well as rapid removal of the garment when desired. Each adjustment strap assembly 106 terminates in a lower strap 108 to which a lower attachment ring 110 is secured. Attachment rings 110 serve to pivotally secure lower straps 108 to frame 14. One or more D rings 112 are also provided on shoulder strap assembly 20 for convenient attachment of tools, accessories and the like. On a rear face of back pad 104 are provided a lower restraining strap 114 for holding pad 104 closely adjacent to frame 14 when assembled thereon, as well as a strip 116 of a hook and loop fastening system. The latter strip is located so as to lie in mutually facing relation with corresponding hook and loop fastener region 46 of frame 14. Finally, each shoulder strap 102 includes features for attachment of bust panel assembly 22. While bust panel 22 may be stitched or otherwise permanently attached to shoulder straps 102, in the presently preferred embodiment, a zipper strip 118 is provided on an inner, facing edge of each shoulder strap 102 for mating with a similar zipper strip 126 of the panel assembly. A fabric cover or flap 120 is stitched to each shoulder strap 102 adjacent to the zipper strips 118, and bears a hook and loop fastener strip 122 for selectively covering the zipper when the garment is worn.

As shown in FIGS. 1 and 3A, bust or chest panel assembly 22 preferably includes a pair of elastic fabric panels 124. Lateral zipper strips 126 on each panel permit their attachment to corresponding zipper strips 118 of shoulder straps 102. Additional zipper strips 128 allow panels 124 to be conveniently joined to one another. While this arrangement is preferred, alternative configurations presently contemplated include forming bust panel assembly 22 of a single expanse of fabric, or providing an additional fabric panel 129 that may be zipped between panels 124. As will be appreciated by those skilled in the art, panels 124 of various sizes may be provided to allow garment 10 to be worn comfortably by persons of different morphologies and sizes. Each panel 124 also includes a hook and loop fastener strip 130 designed to mate with strips 122 of shoulder straps 102 to cover the lateral zipper closures when panels 124 are attached to shoulder straps 102.

Assembly of the several subassemblies of garment 10 proceeds as follows. Following their separate assembly, air cell assembly 12 and shoulder strap assembly 20 are joined to one another by stitching upper portions of air cell 24, adjacent to fill and vent valves 28 and 32, to the upper edge of back pad 104. Separately, lower attachment straps 54 and pivot control strap 58 are coupled to frame 14 in their respective slots 52 and 56. Air cell assembly 12 and pocket assembly 18 are then joined to frame 14 by placement and securement of rivets 62, as shown in FIGS. 3C and 3B. It should be noted that in the presently preferred embodiment illustrated, several two-part plastic rivets are employed to join pocket assembly 18 to the frame 14, while additional rivets are used for attaching air cell assembly 12 to frame 14. Rivets along the lower periphery of aperture 34 serve to couple both air cell assembly 12 and pocket assembly 18 to frame 14. Alternatively, assemblies 12 and 18 may be secured to frame 14 completely independently (i.e., via separate, non-common rivets or other attachment means), particularly where air cell assembly 12 is intended to be removable from frame 14 for replacement purposes. As mentioned above, bust panels 124 are joined to shoulder strap assembly 20 by attachment of zipper strips 126 to corresponding strips 118 of each shoulder strap. Flaps 120 may then be laid over the closed zippers by pressing the corresponding hook and loop fastener strips 122 and 130 into contact with one another. Following attachment of the air cell and pocket assemblies to frame 14, elastic straps 41 are crossed behind pocket assembly 18 and attached, via a ladder lock or similar device, to corresponding attachment straps (not shown) on either side of pocket assembly 18.

Shoulder strap assembly 20 is subsequently rigged to frame 14 as follows. Lower attachment rings 110, each of which bears an attachment pin 111, are joined to frame 14 by pressing pin 111 through pivot holes 65 (see FIG. 3B). Upper straps 50 are then fed through slots 48 as shown in FIG. 3B, exiting the lower slot on the inner surface of frame 14. These straps are then crossed and coupled (i.e., buckled) to lower attachment straps 54. In the preferred embodiment illustrated, lower straps 54 are fed between back pad 104 and restraining strap 114 prior to connection to upper straps 50. This arrangement allows lower straps 54 to urge back pad 104 toward frame 14, while allowing the diver to lift back pad 104 as desired for adjustment of straps 50 and 54. Back pad 104 may then be laid flat against frame 14 by pressing hook and loop fastener strips 46 and 116 into contact with one another.

Belt assembly 16 is then joined to the garment as follows. With pad 70 secured to belt panel 68 via rivets 74 as described above, belt assembly 16 is placed between lower comers of frame 14 as shown in FIG. 3A. Bolts 84 extending from panel 68 are passed through holes 64 (see FIG. 8) and nuts 86 are screwed into place on the bolts to form a solid, pivotable joint at the lower corners of frame 14, as shown in FIG. 7. In the preferred embodiment illustrated, each nut 86 is provided with a head 132 having a bearing surface 134 of reduced diameter that is brought to bear on the inner periphery 136 of holes 64 (see FIG. 8), thereby allowing pivotal movement of belt assembly 16 with respect to frame 14. Lumbar or pivot control strap 58 is then fed through slots 76 of belt assembly 16 as illustrated in FIG. 5, passing over belt assembly 16 and down between pad 70 and belt panel 68, to be joined to attachment strap 77. Finally, buckle straps 80 are fed between pad 70 and restraining strap 96 of pocket assembly 18 to draw pocket assembly 18 into proximity with belt assembly 16 as the garment is fastened around the diver's waist.

Following their attachment to frame 14, upper webbing straps 50 and pivot control strap 58 are adjusted as follows. The combined length of upper straps 50 and lower straps 54 may be increased or decreased by adjustment of ladder locks 140 provided on lower straps 58. By shortening this combined length, the diver may raise the position of frame 14 with respect to shoulder straps 102. Conversely, for divers having a greater torso length, lengthening the combined length of straps 50 and 58 allows for lowering of frame 14. Similarly, pivot control strap 58 is adjusted with respect to attachment strap 77 to lengthen or shorten the combined length of both straps. Because the present garment advantageously allows for pivotal movement of belt assembly 16 with respect to frame 14, straps 58 and 77 effectively limit pivotal movement of frame 14 in a rearward direction by abutting the upper edge of belt assembly 16. This arrangement is particularly useful when belt assembly 16 is fastened tightly around the diver's waist or hips, and facilitates limiting movement of frame 14, which will typically support a tank of breathing gas.

After assembly and preliminary adjustment of garment 10 as described above, the diver may further adjust the fit of shoulder strap assembly 20 via adjustment strap assembly 106 as illustrated in FIGS. 4A–4D. As shown in FIG. 4A, adjustment strap assembly 106 includes an upper attachment strap 150 secured to a quick release buckle 152. A mating buckle portion 154 is provided on an upper end of lower strap 108, which is secured to frame 14 via attachment ring 110. Lower strap 108 is sewn to a lower end of shoulder strap 102, then passed through ring 110. Thereafter, strap 108 passes through a rectangular ring 156 fixed to the lower end of shoulder strap 102, and is routed upwardly toward buckle portion 154. After insertion into buckle portion 154, lower strap 108 is attached to a D ring 158 such that buckle portion 154 forms an upper loop defining a back portion 160 of strap 108 and a front portion thereof 162.

Before use, the diver initially adjusts assembly 106 by attaching buckle portions 152 and 154 to one another as shown in FIG. 4B. Frame 14 is then drawn toward shoulder strap 102 by pulling back portion 160 of strap 108, as indicated by arrow 164 in FIG. 4C. The slack created by this step is then taken up by pulling ring 158 downwardly, as indicated by arrow 166 in FIG. 4D, thereby securing the appropriate length of rear strap 160 between lower buckle portion 154 and attachment ring 110.

It should be noted that the foregoing adjustment strap arrangement provides several advantages during use of garment 10. After the diver has adjusted the strap assembly, buckle portions 152 and 154 may be released from one another, allowing lower strap 108 to slide through ring 156 until buckle portion 154 contacts ring 156, as shown in FIG. 4A. This released or slack position permits the diver easily to put on and remove the garment before and after a dive. After preparation for the dive, the diver need only buckle portions 152 and 154 together to return the shoulder straps to their tight, preadjusted use position shown in FIG. 4D.

It should also be noted that the combination of subassemblies of garment 10 provide a number of advantages over heretofore known diving support garments and buoyancy compensating devices. For example, the use of an elastic bust panel extending between the shoulder supports of garment 10 provides a comfortable, tight garment that is easy to put on and remove. The panel obviates the need to cross shoulder straps or fasten a sternum strap as in other garments, offering a particular advantage to female divers. Furthermore, when garment 10 is provided with pocket assembly 18 integrating a ballast weight system, the diver need not revert to a separate ballast weight belt as in certain other buoyancy compensating and tank support devices. Moreover, it has been found that the foregoing structure provides excellent support of considerable loads carried by the diver during routine dives, while offering great freedom of movement, particularly due to the pivotal arrangement of frame 14 and its associated subassemblies with respect to belt assembly 16. Finally, the preferred assembly techniques described above provide an extremely cost effective method of bringing together the various subassemblies of garment 10 in a solid, unified structure. In particular, the use of rivets or similar attachment structures at predetermined locations in belt assembly 16, and between frame 14 and air cell assembly 12 and pocket assembly 18 allow these structures to be preformed and assembled easily, and facilitates eventual replacement of elements of garment 10 over time as needed.

While the embodiments illustrated in the FIGURES and described above are presently preferred, it should be understood that these embodiments are offered by way of example only and may be adapted to various other structures.

We claim:

1. An equipment support garment for use by an underwater diver, comprising:

a rigid frame adapted to support an element of diving equipment;

first and second panels coupled to the frame and configured to extend over the shoulders of the diver and left and right portions of the diver's chest, respectively;

an air cell coupled to the first and second panels, the air cell comprising an air tight inner compartment for receiving compressed air; and a flexible bust panel coupled to and extending between the first and second panels, wherein the bust panel is configured to continuously extend from the left portion of the diver's chest to the right portion of the diver's chest to substantially cover the diver's chest from the left side to the right side of the diver.

2. The equipment support garment of claim 1, wherein the bust panel includes a first portion attached to the first panel and a second portion attached to the second panel, the first and second portions being selectively attachable to and detachable from one another.

3. The equipment support garment of claim 1, wherein the bust panel is removable from the first and second panels.

4. The equipment support garment of claim 1, wherein the bust panel includes a first portion attached to the first panel, a second portion attached to the second panel and a central portion between the first and second portions, wherein the central portion detachable from the first and second portions.

5. The equipment support garment of claim 1, wherein the first and second panels comprise padded shoulder straps.

6. The equipment support garment of claim 1, wherein the air cell is removable from the garment.

7. The equipment support garment of claim 1, wherein the first and second panels are coupled to an upper region of the rigid frame, wherein the frame is adapted to receive and support a tank of compressed gas.

8. The equipment support garment of claim 7, wherein the rigid frame includes lower portions at least partially extending around the diver's hips.

9. The equipment support garment of claim 8, wherein the rigid frame is pivotally coupled to a belt assembly.

10. The equipment support garment of claim 1, wherein the bust panel is flexible so as to arcuately conform from above to below the diver's chest.

11. The equipment support garment of claim 10, wherein the bust panel is elastic.

12. The equipment support garment of claim 1, wherein the bust panel has a length sufficient so as to extend from the first panel to the second panel and a width sufficient so as to extend from the upper portion of the diver's chest to below the diver's chest.

13. The equipment support garment of claim 1, including first and second shoulder straps connected to the first and second panels, respectively, wherein the first and second straps are pivotally coupled to the rigid frame.

14. The equipment support garment of claim 1, wherein the rigid frame includes lower support extensions configured to at least partially extend around the diver's hips and wherein the equipment support garment includes a belt assembly adapted to be pivotally coupled to the lower support extensions above and in substantial alignment with the diver's hips.

15. The equipment support garment of claim 14, wherein the lower support extensions each have a first side that extends within a first plane, wherein the belt assembly has a second side that faces the first side and that extends within a second plane and wherein the lower support extensions and the belt assembly are pivotally coupled to one another for rotation about an axis oblique to at least one of the first and second planes.

16. The equipment support garment of claim 14, wherein the lower support extensions each have a first side that extends within a first plane, wherein the belt assembly has a second side that faces the first side and that extends within a second plane and wherein the lower support extensions and the belt assembly are pivotally coupled to one another for rotation about an axis oblique to at least one of the first and second planes.

17. An equipment support garment for use by au underwater diver, comprising:

an element of diving equipment to be transported by the diver;

a rigid frame including a panel for supporting the element of diving equipment and lower support extensions configured to at least partially encompass the diver's hips;

a pair of shoulder supports coupled to the frame for supporting the frame on the diver's back; and a belt assembly pivotally coupled to the lower support extensions and configured to extend around the diver's hips, wherein the lower support extensions each have a first side that extends within a first plane, wherein the belt assembly has a second side that faces the first side and that extends within a second plane and wherein the belt assembly is pivotally coupled to the lower support extensions for rotation about an axis oblique to at least one of the first and second planes in which the lower support extensions and the belt assembly extend.

18. The equipment support garment of claim 17, wherein the element of diving equipment includes an air cell having an air tight inner compartment for receiving compressed air.

19. The equipment support garment of claim 17, wherein the element of diving equipment includes a ballast weight pocket assembly.

20. The equipment support garment of claim 17, wherein the element of diving equipment includes a tank of compressing breathing gas.

21. The equipment support garment of claim 17, wherein the shoulder supports are coupled to the lower support extensions of the frame via pivotal connections.

22. The equipment support garment of claim 17, wherein the belt assembly is removably coupled to the lower support extension of the frame and includes at least one pad located so as to extend between the frame and the diver's body.

23. The equipment support garment of claim 17, further comprising a pocket assembly coupled to the belt assembly and at least partially surrounding the belt assembly.

24. The equipment support garment of claim 23, wherein the pocket assembly includes at least one pocket for receiving a ballast weight.

25. The equipment support garment of claim 17, further comprising a flexible panel extending between the shoulder supports and adapted to continuously extend from the left portion of the diver's chest to the right portion of the diver's chest to cover at least a portion of the diver's chest from the left side to the right side of the diver when worn.

26. The equipment support garment of claim 17, wherein the lower support extensions each have a first side that extends within a first plane, wherein the belt assembly has a second side that faces the first side and that extends within a second plane and wherein the belt assembly is pivotally coupled to the lower support extensions for rotation about an axis oblique to at least one of the first and second planes in which the lower support extensions and the belt assembly extend.

27. A buoyancy compensator for use by underwater divers, comprising:

a backpack configured to receive and support a tank of pressurized gas;

a pair of shoulder supports coupled to the backpack and configured to extend over the diver's shoulders when worn, the pair of shoulder supports having an adjustable length;

an air cell coupled to the backpack and including an air tight inner compartment for receiving pressurized gas;

a belt assembly coupled to the backpack and configured to extend around the diver's hips when worn; and an elastic bust panel coupled to and extending between the shoulder supports and adapted to continuously extend from the left portion of the diver's chest to the right portion of the diver's chest wherein the panel is configured to cover at least a portion of the diver's chest from the right side to the left side of the diver when worn.

28. The buoyancy compensator of claim 23, wherein the bust panel includes at least two panel portions joinable to one another via a zipper closure.

29. The buoyancy compensator of claim 27, wherein each of the shoulder supports include upper and lower webbing straps and a quick release device for joining the upper webbing strap to the lower webbing strap, wherein attachment of the quick release device places the shoulder supports in a worn position, wherein the shoulder supports each have a first continuous length and wherein detachment of the quick release device permits extension of the shoulder supports to a release position, wherein the shoulder supports each have a second longer continuous length.

30. The buoyancy compensator of claim 27, wherein the air cell is secured to the backpack via rivets.

31. The buoyancy compensator of claim 27, wherein the backpack includes a rigid frame having lower lateral supports extending at least partially around the diver's hips when worn.

32. The buoyancy compensator of claim 31, wherein the lower lateral supports of the frame are pivotally coupled to the belt assembly.

33. The buoyancy compensator of claim 27, wherein the belt assembly includes a substantially rigid hip panel and a hip pad at least partially covering the hip panel, the hip panel forming a pair of lower lateral recesses configured to rest over the diver's hips when worn.

34. An equipment support garment for use by an underwater diver, comprising:

an element of diving equipment to be transported by the diver;

a support harness including a frame including a frame panel for supporting the element of diving equipment and a pair of shoulder supports coupled to the frame for supporting the frame on the diver's back; and a belt assembly coupled to the support harness, the belt assembly including a support panel, a pad joined to the support panel and an adjustable buckle strap extending from ends of the support panel, wherein a plurality of fasteners are disposed at predetermined locations on the support panel and extend between the support panel and the pad thereby securing the panel to the pad.

35. The equipment support garment of claim 34, wherein the fasteners are two-part rivets.

36. An equipment support garment for use by an underwater diver, the equipment support garment comprising:

first and second panels configured to extend over the shoulders of the diver and left and right portions of the diver's chest, respectively;

an air cell coupled to the first and second panels, the air cell comprising an air tight inner compartment for receiving compressed air; and a bust panel extending continuously between the first and second panels and configured to substantially cover left and right portions of the diver's chest, wherein the bust panel is removable from at least one of the first and second panels.

37. An equipment support garment for use by an underwater diver, the equipment support garment comprising:

first and second panels configured to extend over the shoulders of the diver and left and right portions of the diver's chest, respectively;

an air cell coupled to the first and second panels, the air cell comprising an air tight inner compartment for receiving compressed air; and a bust panel extending between the first and second panels and configured to substantially cover the diver's chest, wherein the bust panel includes a first portion attached to the first panel, a second portion attached to the second panel and a central portion between the first and second portions, wherein the central portion is detachable from the first and second portions.

38. An equipment support garment for use by an underwater diver, the garment comprising:

an air cell including an airtight inner compartment for receiving compressed air;

first and second shoulder supports coupled to the air cell, each of the first and second shoulder supports having an adjustable length; and a flexible bust panel extending between the shoulder supports and adapted to continuously extend from the left portion of the diver's chest to the right portion of the diver's chest, wherein the bust panel is configured to cover at least a portion of the diver's chest from the left side to the right side of the diver when worn.

39. An equipment support garment for use by an underwater diver, the equipment support garment comprising:

a rigid frame adapted to support an element of diving equipment, wherein the rigid frame includes lower support extensions configured to at least partially extend around the diver's hips;

first and second panels coupled to the frame and configured to extend over the shoulders of the diver and left and right portions of the diver's chest, respectively;

an air cell coupled to the first and second panels, the air cell comprising an air tight inner compartment for receiving compressed air;

a flexible bust panel extending between the first and second panels and configured to substantially cover the diver's chest; and a belt assembly adapted to be pivotally coupled to the lower support extensions above and in substantial alignment with the diver's hips.

* * * * *